US006206233B1

(12) United States Patent
Schulze

(10) Patent No.: US 6,206,233 B1
(45) Date of Patent: Mar. 27, 2001

(54) BLISTER PACKAGED PILL EJECTION METHOD AND APPARATUS

(75) Inventor: Herbert C. Schulze, Reno, NV (US)

(73) Assignee: Dynachieve, Inc., Reno, NV (US)

( * ) Notice: Subject to any disclaimer, the term of this patent is extended or adjusted under 35 U.S.C. 154(b) by 0 days.

(21) Appl. No.: 09/306,208

(22) Filed: May 6, 1999

(51) Int. Cl.[7] ..... G07F 11/66
(52) U.S. Cl. ..... 221/25; 221/26
(58) Field of Search ..... 221/25, 26, 74, 221/131

(56) References Cited

U.S. PATENT DOCUMENTS 5,722,563 * 3/1998 Hunts ..... 221/25

* cited by examiner

*Primary Examiner*—Kenneth W. Noland

(57) ABSTRACT

A method and apparatus for medical pills and the like from blister packs utilizing a flexible arm with a uniquely designed pressure member fastened to a base have a specially designed cup to be used as a base support for a blister pack and as a receiving receptacle for the cup. An auxiliary serrated wheel is included for serrating particularly tough blister backing materials when needed.

5 Claims, 2 Drawing Sheets

FIG. 4
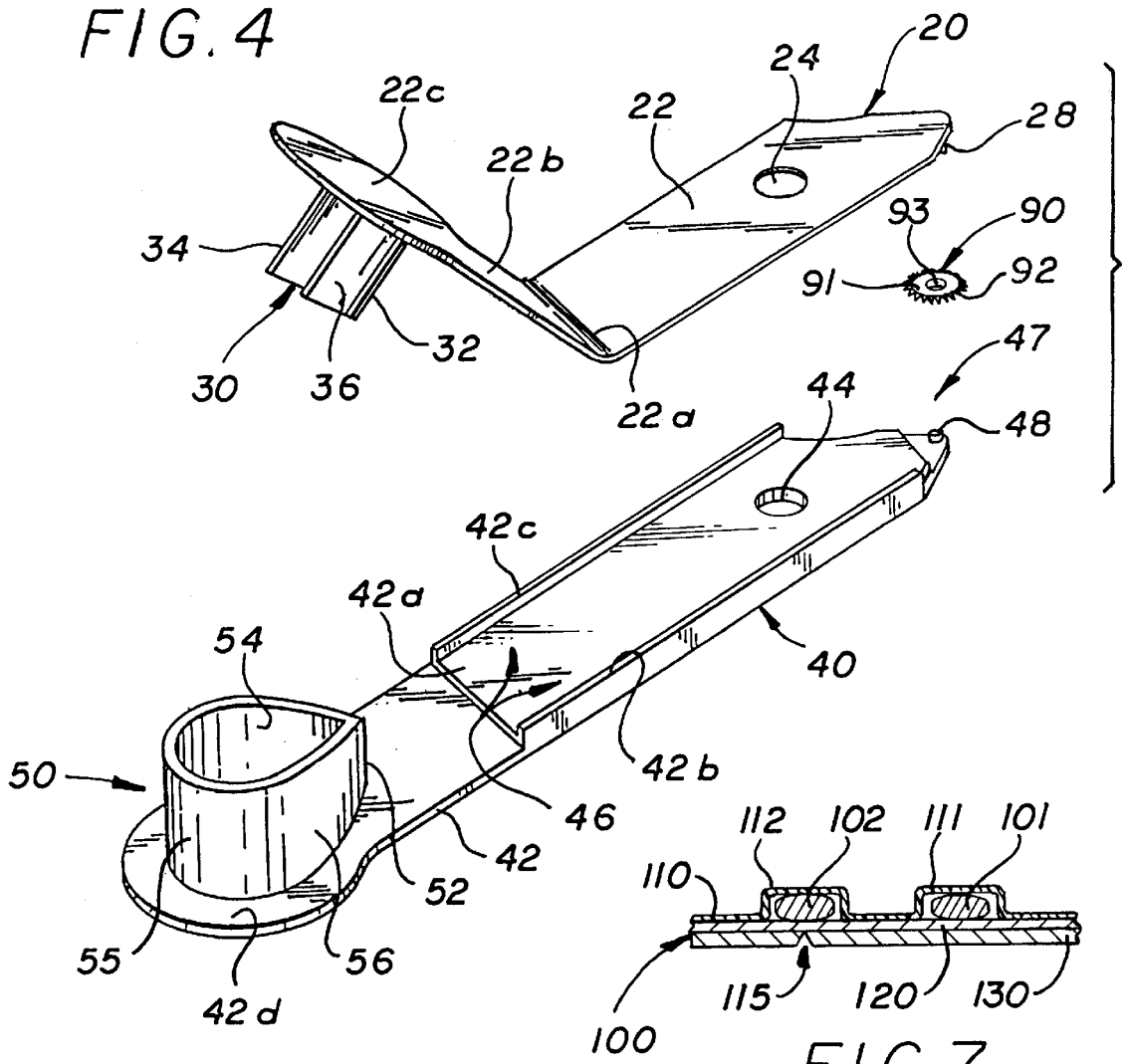
FIG. 7
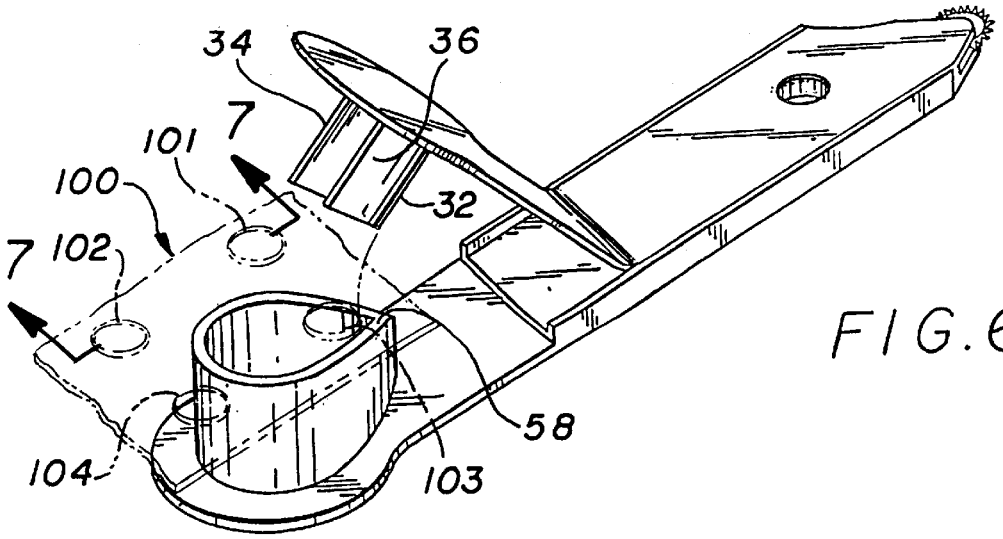
FIG. 6

BLISTER PACKAGED PILL EJECTION METHOD AND APPARATUS

CROSS REFERENCE TO RELATED PATENT APPLICATIONS

There are no patent applications filed by me related to this application.

BACKGROUND OF THE INVENTION

I. Field of the Invention

This invention is in the general fields of medications, vitamin supplements and the like;

The invention is more particularly in the fields of removal of pills, tablets, caplets, capsules and the like from blister packaging;

The invention is even more precisely directed to an inexpensive, easily portable, device and method for removing blister packaged pills from their packaging, which device and method can be used by persons with arthritis and other afflictions limited in their strength and hand dexterity.

II Description of the Prior Art

I am aware of U.S. Pat. Nos. 4,690,279; 4,909,414; 4,975,015; 5,368,187; and 5,722,563 which have to do with removing pills and the like from blister packs. I am also aware of a clamshell-like device which attempts to do this by pushing a blister packed pill against a sponge rubber.

The prior art of which I am aware is generally ineffective for use by individuals. Some of the prior art is specifically directed to equipment not at all suitable for an individual user. Additionally, all of the prior art with which I am familiar is difficult or impossible for use by persons with arthritis and other disabilities.

None of the prior art of which I am aware has the unique features of my present invention which include, without limitation: very small size; extremely light weight; usable in one hand or by pressing with a palm, or arm; usable by persons with arthritis or other hand impairments; uniquely configured to accommodate virtually every size blister packed medical and supplement item; unusual cup member which receives the item being removed from the blister; and unique means for supplemental weakening of the blister pack backing without danger of cutting.

None of the prior art embodies the unique combination of features possessed by my new pill remover as disclosed below.

SUMMARY OF THE INVENTION

Medicinal, diet supplement vitamin, and other pills, tablets, capsules, caplets and the like are in great, and increasing, use throughout the world. For ease and sanitation of packaging, shipping, and storing of such items a preferred manner of packaging such items is in blister packs. Blister packs are rows of individual pills, tablets, capsules, and the like on a backing material covered by a plastic material with individual pockets (blisters) containing individual pills, tablets, capsules, and the like. To use the item within the blister one must remove, or more generally, break the backing material. Removal of the pills or the like from blister packages is very difficult (and sometimes impossible) for those with arthritis, stroke victims, and even many healthy and active individuals.

A great number of persons using such blister packed items resort to attacking the blister backing with knives, tweezers, and other tools. Some, particularly elderly and impaired, individuals are required to forego medication and the like or seek assistance from others in freeing pills and the like from blister packages. Some persons are totally unable to extract the medication or the like.

As indicated above, there have been a limited number of attempts to solve this problem. To date, nothing has been completely satisfactory.

I have studied and experimented on this problem at length. The prior attempts to solve this problem seem to have been primarily directed to a brute force solution. Brute force, however, does not work when one is unable to apply brute force (arthritics, etc.). Brute force does not work where the nature of the item is somewhat resilient as is the case with many blister packed items.

After much consideration and experimentation I have finally conceived and developed a method and device which allows even weak and debilitated persons to remove blister packed items from the packaging.

The manner in which I have accomplished this is the construction of a specially designed, nearly heart shaped, angularly disposed open top cup-like element to support the blister packed items, regardless of their size, on the top of the cup-like element in close proximity to the top edges of the cup-like element. A hinged member operable with a single finger, a palm, or an arm carries a specially shaped contact member which contacts the exterior of the blister on a bias in such manner that the blister packed item is easily forced through the blister packing without damaging the item, even including such items as soft gel capsules. A special portion of the item carries a means to independently weaken the backing of such items as desired without the danger of a knife blade as has sometimes been used by persons attempting to extract blister packed pills and the like..

I have constructed this item in such manner that the items removed from blister packs will be sanitary and not subject to contamination.

It is an object of this invention to provide a device to enable an individual to effectively remove blister packed medicinal items and the like from blisters without regard to the strength or dexterity of the individual;

Another object of this invention is to provide such a device which is light weight and compact;

Another object of this invention is to provide such a device which will eject blister packed items from the blister regardless of the composition or shape of the item;

Another object of this invention is to provide such a device which is sanitary and will not contaminate items being removed from blister packs.

The foregoing and other objects and advantages of this invention will be understood by those skilled in the art upon reading the description of a preferred embodiment, which follows, in conjunction with a review of the appended drawings.

BRIEF DESCRIPTION OF THE DRAWINGS

FIG. 4 is an exploded view of the device of FIG. 1;

FIG. 6 is a perspective of the device of FIG. 1 as the device is used to extract pills from blister packages with a portion of a blister packed pill package shown in phantom; and FIG. 7 is a section on 7—7 on FIG. 6.

DESCRIPTION OF A PREFERRED EMBODIMENT

Figure 1:
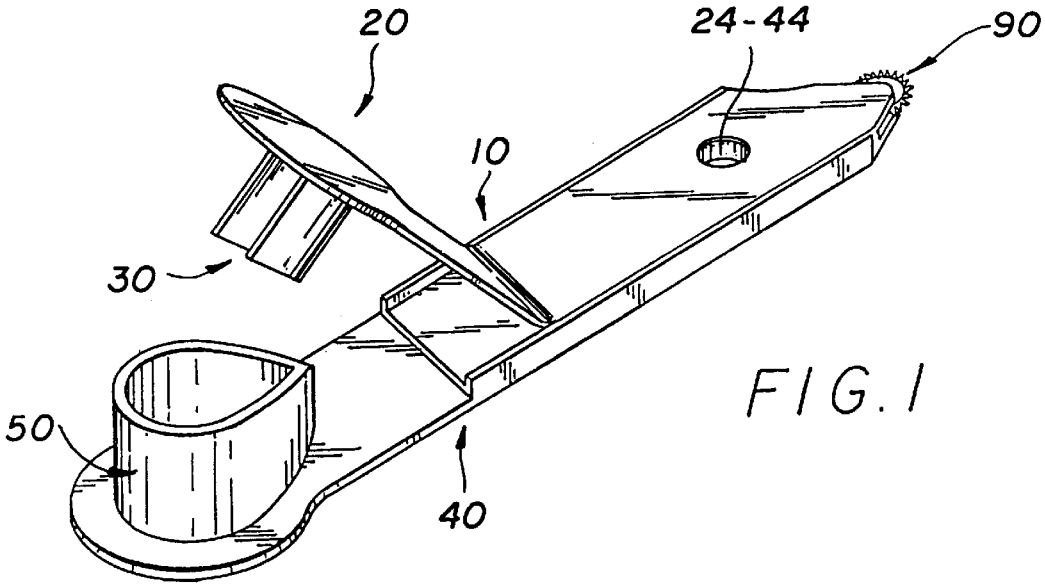
FIG. 1 is a perspective of a device suitable to practice the method of this invention.
Figure 2:
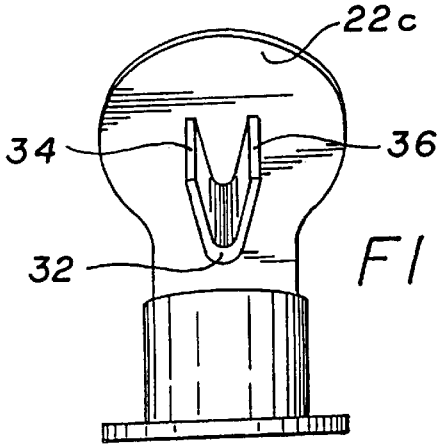
FIG. 2 is a front elevation of the device of FIG. 1.

Inventory of items identified by numeral:

| Numeral | Item |
|---|---|
| 10 | blister packaged pill ejector, generally |
| 20 | flexible extraction element of pill ejector |
| 22 | base connector portion of hinged element |
| 22a | hinge (flex) area |
| 22b | moveable hinged arm |
| 22c | enlarged pressing area |
| 24 | hole in flexible extraction element |
| 24–44 | combined hole through flexible element and base |
| 28 | axle pin on base connector |
| 30 | shaped extraction pressure element |
| 32 | narrow end of pressure element |
| 34 | leg of pressure element |
| 36 | leg of pressure element |
| 40 | base, generally |
| 42 | base element |
| 42a | thickened base portion |
| 42b | flange |
| 42c | flange |
| 42d | enlarged base under receiving cup |
| 44 | hole in base |
| 46 | channel between flanges |
| 47 | end of device |
| 48 | axle pin |
| 50 | pill receiving cup |
| 52 | narrow end of receiving cup |
| 54 | first side of receiving cup |
| 55 | wide end of receiving cup |
| 56 | second side of receiving cup |
| 58 | sloping upper edge of receiving cup |
| 90 | serrated wheel, generally |
| 91 | main wheel body |
| 92 | tapering serrated teeth |
| 93 | axle bore hole |
| 100 | blister packed pills in phantom, generally |
| 101 | pill |
| 102 | pill |
| 103 | pill |
| 104 | pill |
| 110 | blister film |
| 111 | blister |
| 112 | blister |
| 115 | serration in backing |
| 120 | foil |
| 130 | backing material |
| 200 | blister packed pills in phantom, generally |
| 201 | pill |
| 202 | pill |
| 203 | pill |
| 204 | pill |
| 215 | serration in backing |
| 215a | serration in backing to side of pill |

FIGS. 1, 2, 3, and 4 may be viewed together for a quick explanation of the pill ejector of this invention and the method of making and using it.

The blister packaged pill ejector 10 is best made of three fundamental elements: 1) a base, generally 40 including a pill receiving cup 50 and a wheel axle pin 48; 2) a flexible pill extraction element 20 including a shaped pill extraction pressure element 30; and 3) a serrated wheel 90 for weakening the toughest blister pack backing materials. The pill ejector of this invention is preferably made of poly propylene or the like. The flexible pill extraction element 20 and the base 40 with the cup 50 are best injection molded. The serrated wheel 90 may be machined, molded, or otherwise formed by means known to those skilled in the art. Other materials and methods of forming the elements might be used, but because this item involves repeated flexing, poly propylene will be excellent as it has superior ability to flex repeatedly without failure. The serrated wheel 90 may be made of steel, various plastics, molded nylon, or other materials.

The base 40 comprises an elongate element having a thickened portion 42*a* with two edge flanges 42*b* and 42*c*. This forms a channel 46 between the flanges. This channel will receive base connector portion 22 of the flexible extraction element in assembly. An enlarged base area 42*d* carries the pill receiving cup 50. The pill receiving cup 50 has a narrow end 52 as indicated with curved diverging first and second sides 54 and 56 and a wide curved end 55. The upper edge 58 of the cup 50 preferably slopes as indicated at an angle of approximately ten degrees from horizontal. The slope is valuable in that the blister packaged pill is then contacted by the pressure element 30 in such a way that a biased force results with accompanying reduction of pressure required as compared to a direct perpendicular force. A hole 44 is provided in the base element. This hole will align with a corresponding hole 24 in the flexible pressure arm as will be described below. The base has a reduced thickness at the end area 47 (the same thickness as 42 before the thickened portion) and an axle pin 48 of length one half the thickness of serrated wheel 90 is provided as shown.

The flexible extraction element 20 is preferably made in one piece including a base connector portion 22, a hinge area 22*a*, a moveable hinged arm 22*b* with an enlarged pressing area 2*c*. The enlarged pressing area carries a shaped ejection pressure member 30 which is essentially "V" shaped with a narrow end 32 and two diverging legs 34 and 36. This particular configuration allows the exertion of proper pressure against pills as hereinafter described so that pills or the like of different sizes and in differing packaging configurations can be successfully ejected from any blister pack. This shape allows for proper pressure to applied to the smallest of pills as well as to larger pills individually and those packed in multiple quantities within single blisters.

A hole 24 is provided as shown in base connector 22. This hole will align with hole 44 in base 40. The combined holes 24–44 allow for hanging on a hook, a belt, or otherwise when the item is not in use. An axle pin 28 is provided as indicated. The length of axle pin 28 will preferably be half the thickness of serrated wheel 90, The axle pin 28 will align with axle pin 48 on the base. The two pins will touch when the entire item is assembled and will then fuse into a single, very strong, axle during final sonic fusion or the like.

The serrated wheel 90 has a main body 91 with a tapering serrated edge 92 and axle bore 93.

During assembly, bore 93 of the serrated wheel 91 will be placed on the base axle pin 48. The base connector portion of the flexible element will be placed within the channel 46 with the axle pin 28 inserted into the axle bore 93. The ends of axle pins 28 and 48 will be in contact. The assembled unit will then be sonic welded by customary sonic welding, or joined by other means known to those skilled in the art.

Figure 5:
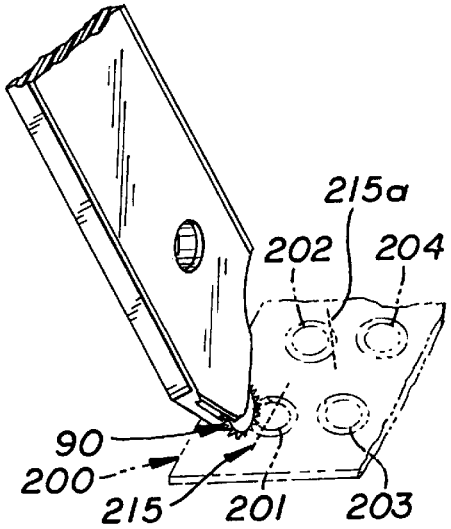
FIG. 5 is a broken away perspective of the rear end of the device of FIG. 1 showing the use of a scoring element to score the backing on blister packed pills, with the blister pack shown in phantom.
Figure 3:
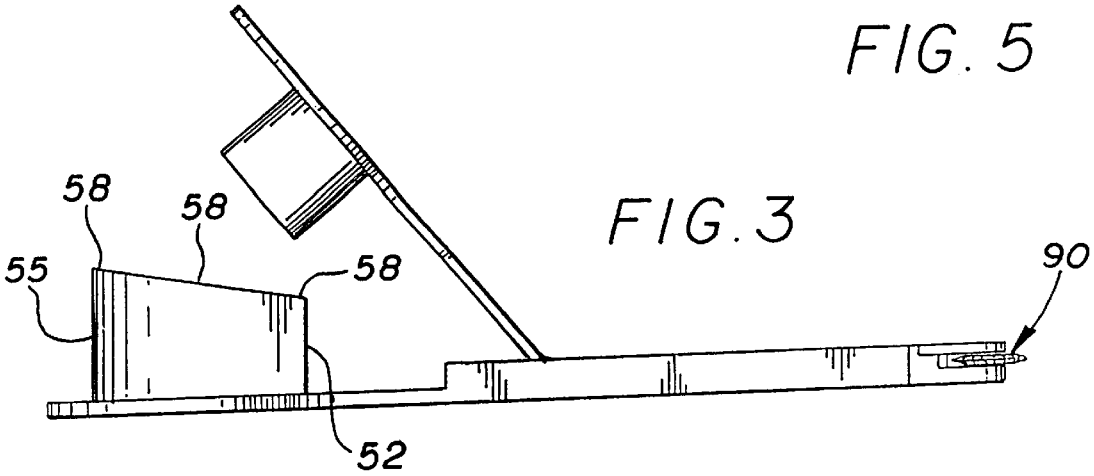
FIG. 3 is a side elevation of the device of FIG. 1.

FIG. 5 illustrates the use of the serrated wheel 90 to weaken particularly tough backing materials before extraction from blister packs. In FIG. 5, the blister packed pills are shown in phantom as a broken away portion 200 of a complete blister package. In this illustration four blister packed pills, 201, 202, 203, and 204 are shown. The serrated wheel 90 has been pressed against the backing under the blister packed pill 201 and rolled along leaving a series of serrations 215. This has weakened the backing to an extent where pill removal as explained in connection with FIG. 6 is quite easy.

FIG. 5 also shows a serration 215*a* caused by the serrated wheel 90 adjacent the back of pill 202. This is important since I have found that frequently the removal of a pill will be much more effective with serrations of the backing to the side of the pill rather than directly beneath the pill. This results in easier and more effective pill removal.

FIG. 6 shows a portion of a blister pack 100 in phantom. Blister packed pills 101, 102, 103, and 104 are shown resting on edge 58 of pill receiving cup 50. The pill to be extracted will be pill 103. It is preferably placed as shown, as near the narrow end of the receiving cup as possible. The closer the pill is to the supporting edge 58, the easier it is to remove the pill. The advantage of the shape of the receiving cup is that regardless of the size and shape of the pill the maximum support and leverage will exist. After pill 103 is extracted it makes no difference which pill comes next—it can always be placed in the most advantageous position. The backing material will always be on the cup edge 58 and the pressure to the pill will be applied through the blister. The slope of the edge of the cup 50 from the narrow end 52 upward to the wide end 55 helps to prevent the entire blister pack from sliding away from the optimum pill ejection position.

FIG. 7 illustrates the actual construction of the blister package. Plastic film 110 is formed so that there is a plastic pocket 111 and 112 enclosing each pill 101 and 102. The film 110 around each pocket adheres to a film (commonly aluminum) 120. In some blister packs that is the complete pack. In many packs, however, an additional layer 130 of paper or the like is applied. Some of these various layers under the blisters containing pills are very tough making it impossible for many persons to remove the pills. With particularly tough films the serrated wheel is used to cause serrations 115 in the backing and making it easy to remove the pill with the pill ejector described in this specification.

Particular materials, sizes, configurations and the like may have been described. Where this has been done, it not for purposes of being mandatory. Where suitable, other materials and the like may be used without departing from the unique features and scope of this invention.

While the embodiments of this invention shown and described are fully capable of achieving the objects and advantages desired, they have been shown and described for purposes of illustration only and not for purposes of limitation.

I claim:

1. Apparatus for removing pills from blister packages comprising: a first elongate horizontal base member including a first end having a vertically disposed cup; a second end at a distance from the first end; a second flexible elongate member having a first end attached to the first elongate horizontal base member intermediate the first end and the second end of the first elongate horizontal member and a second end carrying a pressure member disposed above said cup, and a flexible portion of said second elongate member suitable to allow the pressure member to be inserted into the cup.

2. The apparatus of claim 1 wherein the cup is an elongate oval enclosure.

3. Apparatus for removing pills from blister packages comprising: a first elongate horizontal base member including a first end having a vertically disposed cup and a second end at a distance from the first end, said second end carrying a serrated, rotatable wheel; a second flexible elongate member having a first end attached to the first elongate horizontal base member intermediate the first end and the second end of the first elongate horizontal member and a second end carrying a pressure member disposed above said cup, and a flexible portion of said second elongate member suitable to allow the pressure member to be inserted into the cup intermediate its first and second ends.

4. The apparatus of claim 3 wherein the cup has a first and a second end and is pointed at the first end and is a broad curvature at its second end.

5. The method of extracting a blister packed pill from a blister pack comprising: running a serrated wheel over blister pack backing adjacent a pill to be extracted; placing the blister pack backing upon the upper edge of a cup having an upper edge with the pill to be extracted within the confines of the upper edge of the cup and above the upper edge of the cup, the blister being above the upper edge of the cup; and pressing a pressure member against the blister so that the blister is deformed against the pill causing the pill to press against, and break, the blister pack backing and drop into the cup.

* * * * *